US010665934B2

(12) United States Patent
Hashimoto

(10) Patent No.: US 10,665,934 B2
(45) Date of Patent: May 26, 2020

(54) ANTENNA DEVICE

(71) Applicants: KABUSHIKI KAISHA TOSHIBA, Minato-ku (JP); TOSHIBA INFRASTRUCTURE SYSTEMS & SOLUTIONS CORPORATION, Kawasaki-shi (JP)

(72) Inventor: Koh Hashimoto, Yokohama (JP)

(73) Assignees: KABUSHIKI KAISHA TOSHIBA, Minato-ku (JP); TOSHIBA INFRASTRUCTURE SYSTEMS & SOLUTIONS CORPORATION, Kawasaki-shi (JP)

( * ) Notice: Subject to any disclaimer, the term of this patent is extended or adjusted under 35 U.S.C. 154(b) by 0 days.

(21) Appl. No.: 16/123,213

(22) Filed: Sep. 6, 2018

(65) Prior Publication Data

US 2019/0296428 A1 Sep. 26, 2019

(30) Foreign Application Priority Data

Mar. 20, 2018 (JP) ..... 2018-053255

(51) Int. Cl.
*H01Q 21/00* (2006.01)
*H01Q 1/38* (2006.01)
(Continued)

(52) U.S. Cl.
CPC ..... *H01Q 1/38* (2013.01); *H01Q 1/42* (2013.01); *H01Q 15/144* (2013.01); *H01Q 21/0087* (2013.01); *H01Q 21/065* (2013.01)

(58) Field of Classification Search
CPC ..... H01Q 15/144; H01Q 21/0087; H01Q 21/065; H01Q 1/42; H01Q 21/00; H01Q 21/06
See application file for complete search history.

(56) References Cited

U.S. PATENT DOCUMENTS 6,151,310 A * 11/2000 Dent ..... H01Q 1/246 370/330
6,768,471 B2 * 7/2004 Bostwick ..... H01Q 1/286 343/776

(Continued)

FOREIGN PATENT DOCUMENTS

| | | |
|---|---|---|
| JP | 62-48107 | 3/1987 |
| JP | 2017-152848 | 8/2017 |
| JP | 2018-29155 | 2/2018 |

*Primary Examiner* — Hoang V Nguyen
(74) *Attorney, Agent, or Firm* — Oblon, McClelland, Maier & Neustadt, L.L.P.

(57) ABSTRACT

An antenna device according to an aspect of the present invention includes a plurality of radiation elements, an array antenna, a skin material, a core material and an antenna casing. The plurality of radiation elements transmit radio waves of a predetermined frequency. The array antenna has a radiation surface and a back surface opposite to the radiation surface. The plurality of radiation elements are disposed on the radiation surface. The skin material is disposed in a direction in which the skin material faces the radiation surface. The core material is disposed between the array antenna and the skin material, and has a plurality of through-holes. The antenna casing is disposed in a direction in which the antenna casing faces the back surface. A distance between centers of adjacent through-holes of the through-hole is equal to or less than one-half of a wavelength corresponding to the predetermined frequency.

9 Claims, 12 Drawing Sheets

(51) Int. Cl.

| | |
|---|---|
| ***H01Q 1/42*** | (2006.01) |
| ***H01Q 15/14*** | (2006.01) |
| ***H01Q 21/06*** | (2006.01) |

(56) References Cited

U.S. PATENT DOCUMENTS

| | | | |
|---|---|---|---|
| 2017/0244161 | A1 | 8/2017 | Hashimoto et al. |
| 2018/0053983 | A1 | 2/2018 | Mukai et al. |

* cited by examiner

ANTENNA DEVICE

CROSS-REFERENCE TO RELATED APPLICATION(S)

This application is based upon and claims the benefit of priority from Japanese Patent Application No. 2018-053255, filed Mar. 20, 2018; the entire contents of which are incorporated herein by reference.

FIELD

Embodiments described herein relate generally to an antenna device.

BACKGROUND

A resin foam may be bonded as a protection layer to a surface on a radiation element side of an array antenna formed of a dielectric material. The resin foam also provides advantages such as thinning of the antenna device, suppression of antenna gain reduction, and mechanical strength enhancement.

On the other hand, a surface of a radome of an antenna device is warmed to melt snow sticking to the radome in snowy regions. However, there is a problem that no sufficient snow melting effect can be obtained in an antenna device with a resin foam bonded thereto even if the radome is warmed because of a heat insulation effect of the resin foam. Therefore, contrivances for enhancement in warming capability have been studied, but antenna characteristics are often lost by such contrivances.

DETAILED DESCRIPTION

Embodiments of the present invention each provide an antenna device that is suitable for warming and has a suppressed sidelobe level.

An antenna device according to an aspect of the present invention includes a plurality of radiation elements, an array antenna, a skin material, a core material, and an antenna casing. The plurality of radiation elements transmit radio waves of a predetermined frequency. The array antenna has a radiation surface and a back surface opposite to the radiation surface. The plurality of radiation elements are disposed on the radiation surface. The skin material is disposed in a direction in which the skin material faces the radiation surface. The core material is disposed between the array antenna and the skin material and has a plurality of through-holes. The antenna casing is disposed in a direction in which the antenna casing faces the back surface. A distance between centers of adjacent through-holes of the through-hole is equal to or less than one-half of a wavelength corresponding to the predetermined frequency.

Below, a description is given of embodiments of the present invention with reference to the drawings. The present invention is not limited to the embodiments.

First Embodiment

Figure 1A:
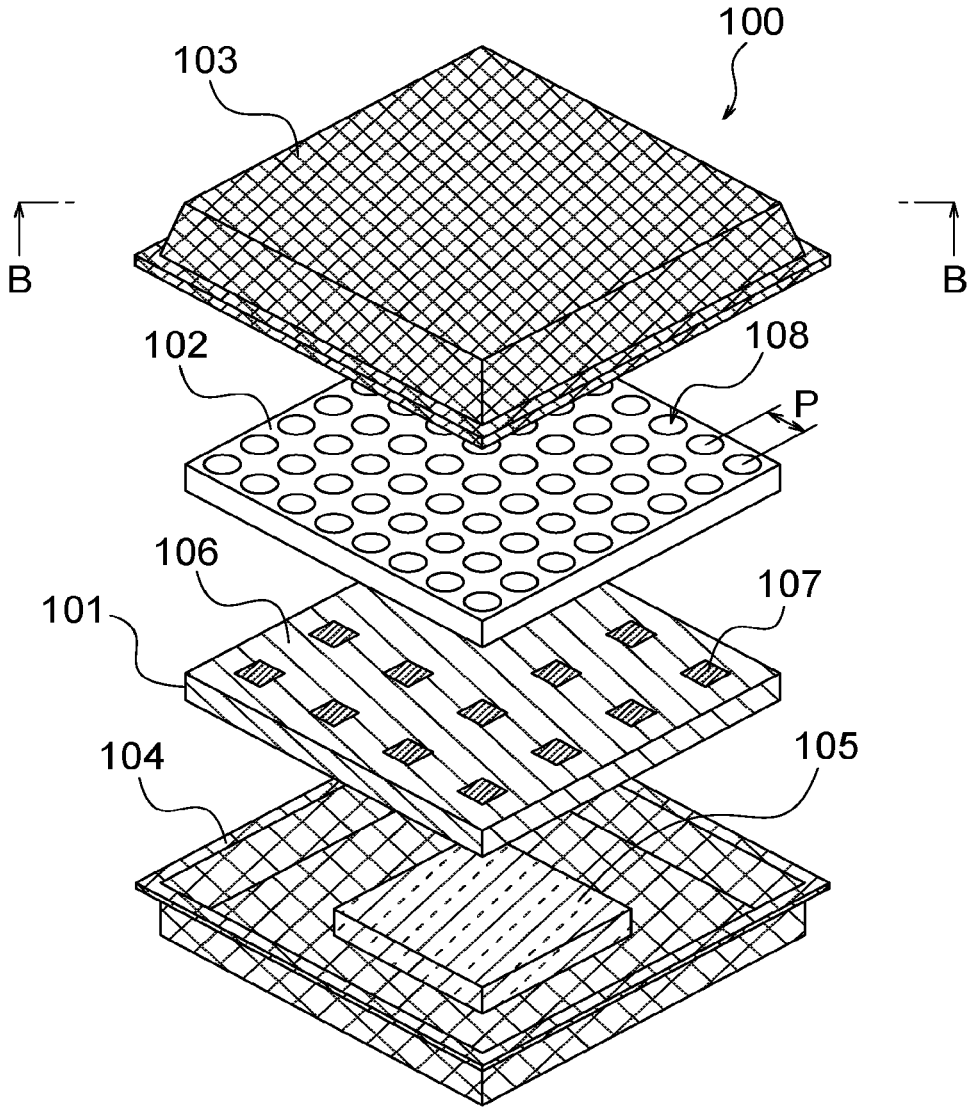
FIG. 1A is an exploded perspective view of an antenna device according to a first embodiment.
Figure 1B:
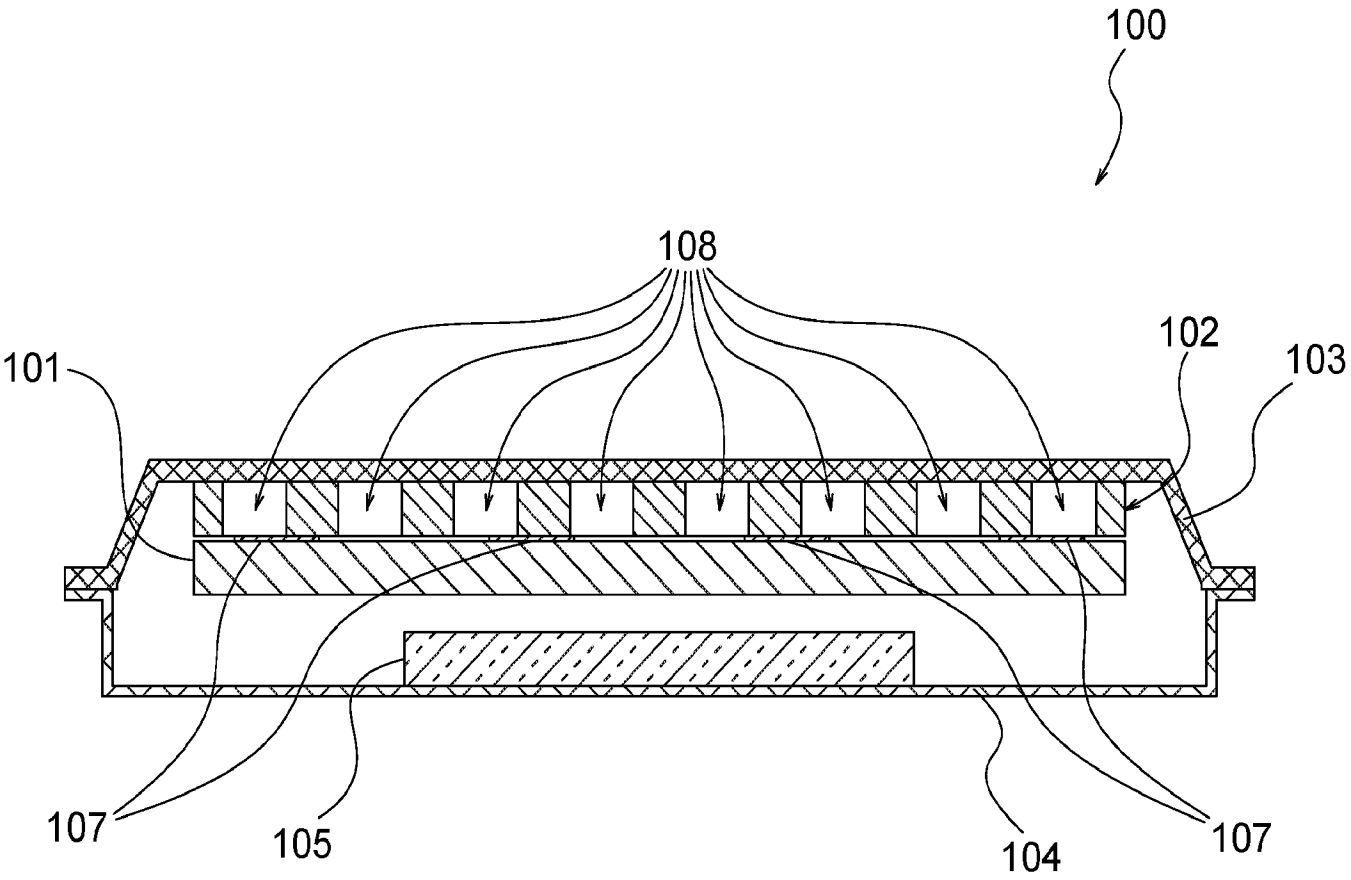
FIG. 1B is a cross-sectional view of the antenna device according to the first embodiment.

FIGS. 1A and 1B are diagrams for describing an antenna device according to a first embodiment. FIG. 1A is an exploded perspective view of the antenna device according to the first embodiment. FIG. 1B is a cross-sectional view of the antenna device according to the first embodiment. The section line for FIG. 1B is line B-B in FIG. 1A. An antenna device 100 according to the first embodiment includes an array antenna 101, a core material 102, a skin material 103, an antenna casing 104 and a heat source 105.

The antenna device 100 illustrated in FIGS. 1A and 1B is disposed so as to radiate radio waves upward. Therefore, the present description will be given assuming that a direction in which the antenna device 100 radiates radio waves is "up".

The antenna device 100 according to the first embodiment warms the inside of the antenna device 100 using the heat source 105 included inside. This is because, for example, if the antenna device 100 is used outdoors in a snowy region, snow may stick to a surface of the antenna device 100 and if the antenna device 100 is left with the snow sticking thereto, the antenna characteristics may deteriorate. Also, the antenna device 100 is configured so as to enhance efficiency of the warming while taking the antenna characteristics into consideration.

The array antenna 101 includes a plurality of radiation elements 107 on a radio wave radiation surface 106 (upper surface in FIGS. 1A and 1B). The radiation elements 107 transmit radio waves of a predetermined frequency. Here, the radiation elements 107 may perform not only transmission but also reception. In other words, the radiation surface is a surface on which the radiation elements 107 from which radio waves are radiated are disposed. The radiation elements 107 are arrayed in a matrix on the radiation surface 106. Here, the number of radiation elements 107 may be determined as appropriate according to the specifications of the antenna device 100.

The array antenna 101 is formed in, for example, a dielectric substrate. For the dielectric substrate, e.g., a resin substrate, a resin foam or a film substrate is used. For the resin substrate, e.g., PTFE (polytetrafluoroethylene) or modified-PPE (polyphenylene ether) is used. For the film substrate, e.g., a liquid-crystal polymer is used.

Although the radiation elements 107 illustrated in FIG. 1 are patch antennas, the radiation elements 107 may be determined as appropriate according to the specifications of the antenna device 100. For the radiation elements 107, for example, e.g., slot antennas or slot loop antennas may be used.

The core material 102 and the skin material 103 protect the radiation surface 106 side of the array antenna 101 from an external environment. That is, the core material 102 and the skin material 103 serve as a radome.

The core material 102 is disposed in a direction in which the core material 102 faces the radiation surface 106 of the array antenna 101. In other words, the core material 102 is disposed on the radio wave radiation side relative to the array antenna 101. Therefore, radio waves from the array antenna 101 pass through the core material. Therefore, in order to avoid an adverse effect on the antenna characteristics, for the core material 102, one having a relative permittivity close to 1 such as a resin foam is used.

Also, the core material 102 has a plurality of through-holes 108. The through-holes 108 are disposed so that a distance between two adjacent through-holes 108 is equal to or less than one-half of a wavelength corresponding to a frequency of radio waves transmitted by the antenna device 100 (hereinafter simply referred to as "wavelength"). The distance between two adjacent through-holes 108 is a distance between centers of the two through-holes 108, and is referred to as "pitch P" as indicated in FIG. 1A. In that disposition, the number of through-holes 108 may be determined as appropriate according to the specifications of the antenna device 100. Also, a shape of the through-holes 108 is not limited to a round shape and may be a regular polygonal shape. Details of the through-holes 108 will be described later.

The skin material 103 is disposed on the opposite side of the core material 102 from the array antenna 101. In other words, the skin material 103 is disposed on the radio wave radiation side relative to the core material 102.

The skin material 103 is also disposed in a direction in which the skin material 103 faces the radiation surface 106 of the array antenna 101. Also, the skin material 103 is disposed on the opposite side of the core material 102 from the array antenna 101. That is, the core material 102 is disposed between the array antenna 101 and the skin material 103.

As the skin material 103, PTFE, which has good weatherability and less attenuates radio waves, may be used. For example, an FRP (fiber-reinforced plastic) having a good mechanical strength may be used.

In order to reduce losses such as a return loss and a dielectric loss, it is preferable that the skin material 103 be sufficiently thin relative to the wavelength corresponding to the frequency of radio waves transmitted by the antenna device 100. Also, if the skin material 103 is thinned, the skin material may be insufficient in mechanical strength. Therefore, the array antenna 101 and a component provided on the radio wave radiation side relative to the array antenna 101 may be brought into contact with each other in order to enhance the mechanical strength. In other words, the skin material 103, the core material 102 and the array antenna 101 may be disposed so as to be in contact with one another to enhance the mechanical strength. Also, if non-conductive material layers are disposed between each two of the skin material 103, the core material 102 and the array antenna 101, the non-conductive material layers may also be brought into contact with the skin material 103, the core material 102 and the array antenna 101 to enhance the mechanical strength.

The antenna casing 104 is disposed on the opposite side of the array antenna 101 from the core material 102. In other words, the antenna casing 104 is disposed in a direction in which the antenna casing 104 faces a back surface opposite to the radiation surface. Also, the antenna casing 104 is joined to the skin material 103 via a method such as screw-fastening or bonding. Consequently, a space surrounded by the skin material 103 and the antenna casing 104 is created. Then, the array antenna 101, the core material 102 and the heat source 105 are included in the space as illustrated in FIG. 1B. Hereinafter, the space is referred to as "internal space".

The heat source 105 is provided in the internal space and warms air in the internal space. The heat source 105 may only be disposed at a position at which the heat source 105 does not block radio waves. For example, the heat source 105 may be disposed on the lower side relative to the array antenna 101 and on the upper side relative to the antenna casing 104 as illustrated in FIG. 1B. In the example in FIG. 1, the heat source 105 is in contact with the antenna casing 104, but the heat source 105 may be in contact with the array antenna 101 or may be in contact with both the antenna casing 104 and the array antenna 101. Also, the heat source 105 may be in contact with neither the antenna casing 104 nor the array antenna 101.

Heat emitted from the heat source 105 disposed in the internal space warms the air in the internal space. Thereby, the skin material 103 is indirectly warmed. Consequently, it becomes possible to melt snow. However, the core material 102 hinders transmission of heat to the skin material 103. In particular, when a resin foam is used as the core material 102, the core material 102 functions as a heat insulation material, and thus, the skin material 103 may fail to be sufficiently warmed. Therefore, the core material 102 has the plurality of through-holes 108 to cause the warmed air to be delivered to the skin material 103 by the through-holes 108. Consequently, it is possible to sufficiently warm the skin material 103.

However, the through-holes 108 and the core material 102 have different relative permittivities because air is charged into the through-holes 108. For that reason, small amplitude variation occurs in antenna aperture distribution in a surface of the skin material 103. Amplitude distribution is generated in accordance with the pitch of the through-holes 108. Hence, a sidelobe level of the antenna may be raised depending on the pitch of the through-holes 108, which is problematic where the antenna device 100 is required to have a low sidelobe level.

Figure 2A:
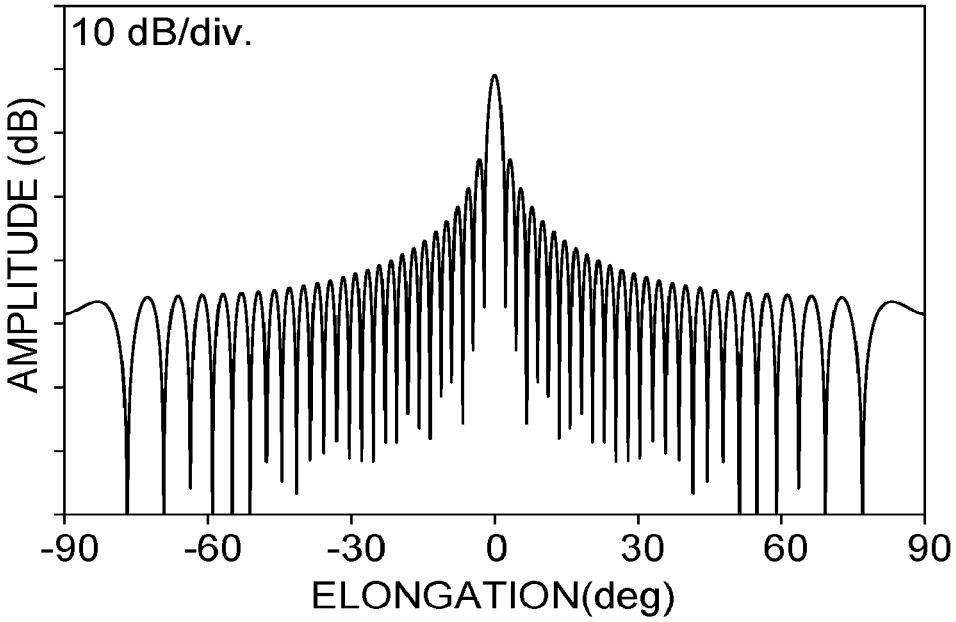
FIG. 2A is a graph indicating radiation pattern of an array antenna alone in the first embodiment.
Figure 2B:
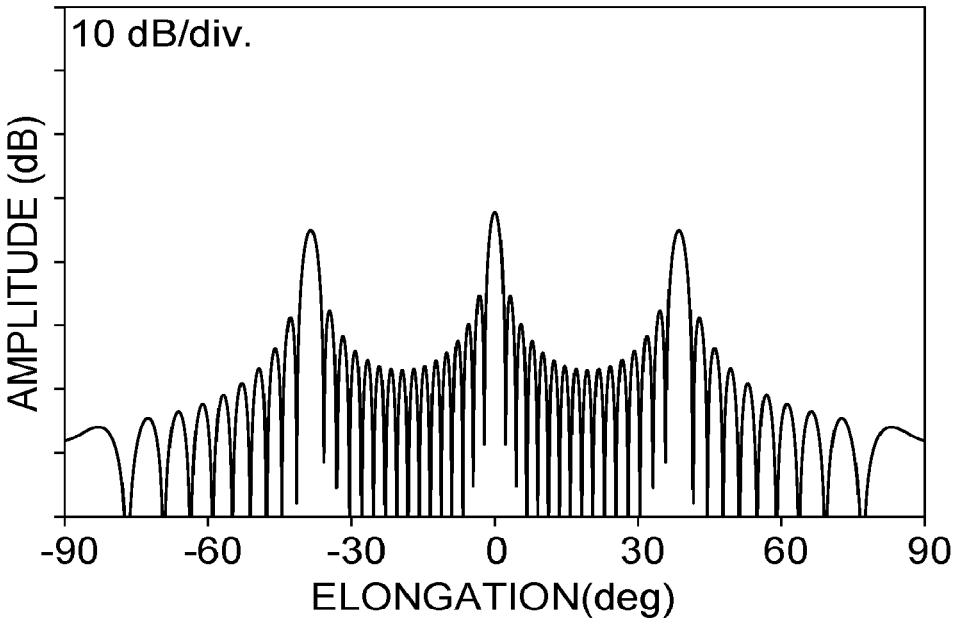
FIG. 2B is a graph indicating contribution of amplitude variation in an antenna aperture, the amplitude variation occurring where a pitch P is greater than one wavelength, to the radiation pattern.

FIGS. 2A and 2B are graphs for describing an influence on radiation pattern where the through-holes 108 cause amplitude variation in the antenna aperture distribution. Amplitude values of a elongation from a line perpendicular to the radiation surface 106 of the array antenna 101 are indicated. Description will be given in terms of amplitude variation changing depending on the pitch P of centers of two adjacent through-holes 108.

In FIGS. 2A to 2G, it is assumed that longitudinal and lateral lengths of an aperture part of the array antenna 101 are both 25 times the wavelength (25×25 wavelength). The amplitude values indicated in FIGS. 2A to 2G are results of simple calculation from an array factor and an element factor. It is also assumed that same-phase excitation of radiation elements 107 is adjusted so that a main beam of the array antenna 101 travels in a direction perpendicular to the radiation surface 106.

FIG. 2A is a graph indicating radiation pattern of the array antenna alone in the first embodiment. That is, FIG. 2A indicates radiation pattern where the core material 102, etc., are not provided on the radiation side. Therefore, there is no influence of the core material 102 and thus no outstanding sidelobe.

FIG. 2B is a graph indicating contribution of amplitude variation in the antenna aperture, the amplitude variation occurring where the pitch P is greater than one wavelength, to the radiation pattern. Where a cycle of amplitude variation is greater than one wavelength, that is, where the core material 102 is provided and the pitch P is greater than one wavelength, the radiation pattern indicated in FIG. 2A is influenced in such a manner as indicated in FIG. 2B. In FIG. 2B, a grating lobe appears in each directions in which the elongation is substantially 35 degrees. As described above, if the pitch P is equal to or greater than one wavelength, grating lobes appear.

Figure 2C:
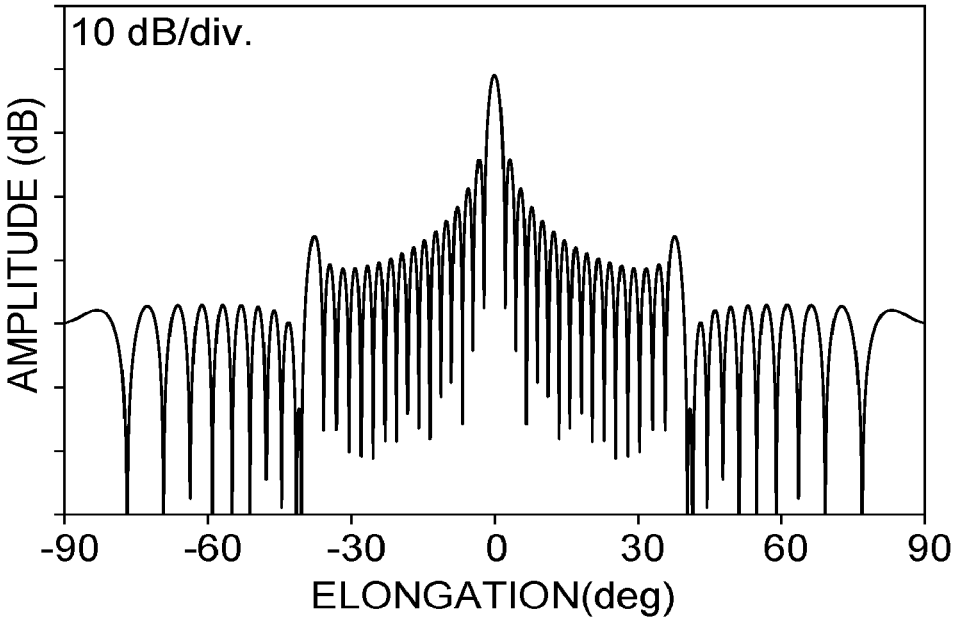
FIG. 2C is a graph indicating radiation pattern where the pitch P is greater than one wavelength.

FIG. 2C is a graph indicating radiation pattern where the pitch P is greater than one wavelength. That is, FIG. 2C indicates radiation pattern resulting from the radiation pattern indicated in FIG. 2A being influenced in such a manner as indicated in FIG. 2B where the pitch P is greater than one wavelength. As a result of the influence of the grating lobes in the FIG. 2B, sidelobes in each of the directions in which the elongation is substantially 35 degrees are raised relative to surrounding sidelobes. If specifications required for the antenna device 100 are not met because of such outstanding sidelobes, it is necessary to decrease the sidelobes.

Figure 2D:
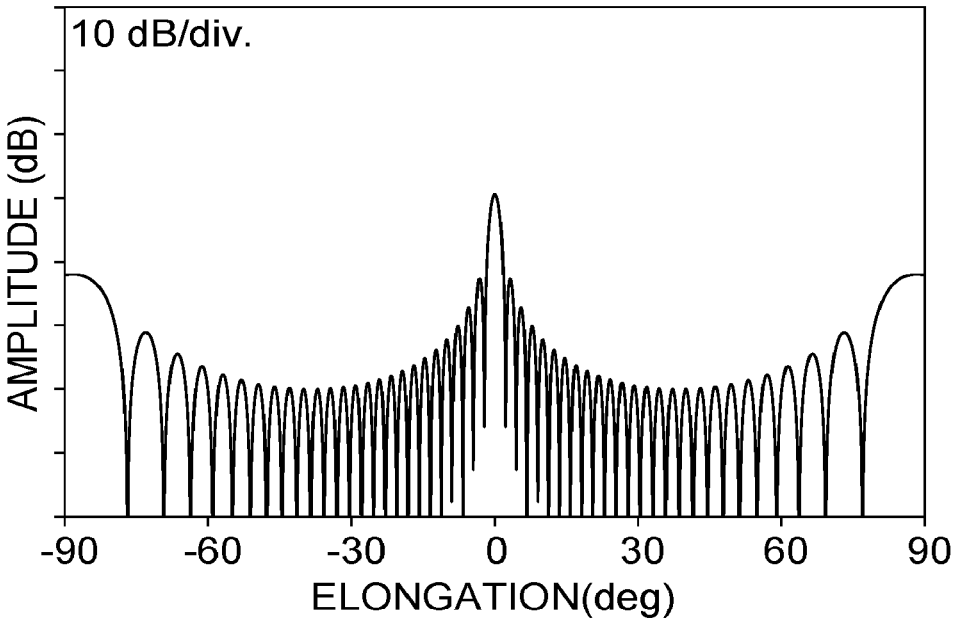
FIG. 2D is a graph indicating contribution of amplitude variation in the antenna aperture, the amplitude variation occurring where the pitch P is substantially one wavelength, to the radiation pattern.

FIG. 2D is a graph indicating contribution of amplitude variation in the antenna aperture, the amplitude variation occurring where the pitch P is substantially one wavelength, to the radiation pattern. If the cycle of the amplitude variation is substantially one wavelength, a grating lobe appears in each directions in which the elongation is substantially 90 degrees.

Figure 2E:
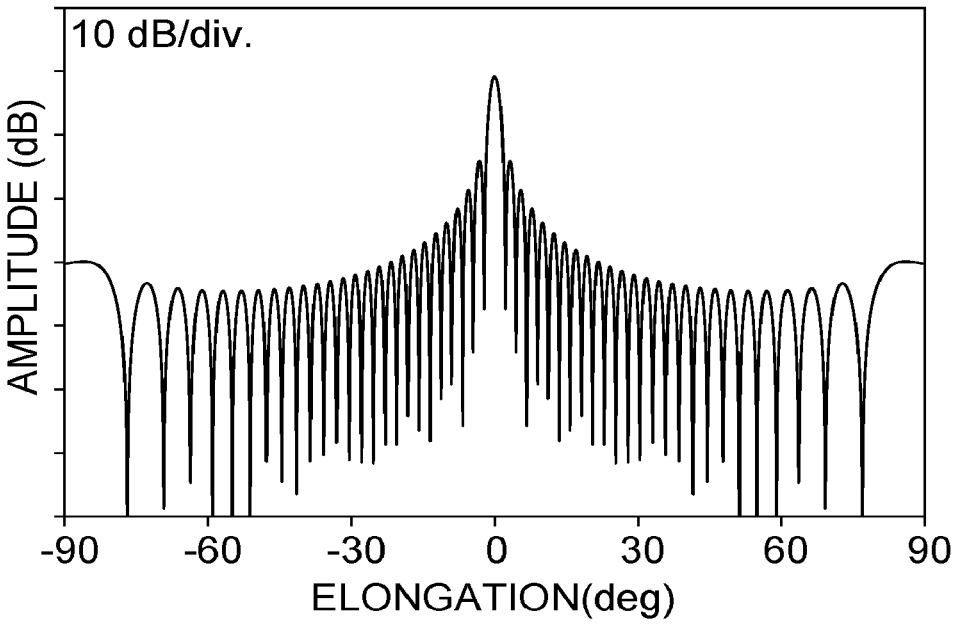
FIG. 2E is a graph indicating radiation pattern where the pitch P is substantially one wavelength.

FIG. 2E is a graph indicating radiation pattern where the pitch P is substantially one wavelength. As a result of the influence of the grating lobes in the directions of substantially 90 degrees, each sidelobes in the directions in which the elongation is substantially 90 degrees is raised relative to the surrounding sidelobes. If sidelobes including those in wide-angle directions are strictly limited for the antenna device 100, it is necessary to suppress the sidelobes.

Figure 2F:
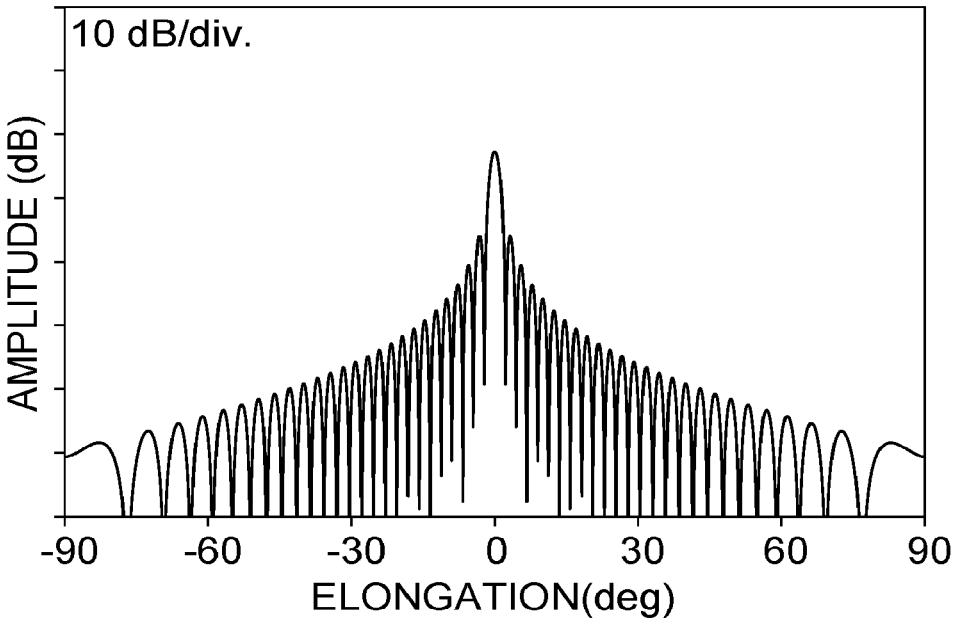
FIG. 2F is a graph indicating contribution of amplitude variation in the antenna aperture, the amplitude variation occurring where the pitch P is equal to or less than a half wavelength, to the radiation pattern.

FIG. 2F is a graph indicating contribution of amplitude variation in the antenna aperture, the amplitude variation occurring where the pitch P is equal to or less than a half wavelength, to the radiation pattern. Where the pitch P is equal to or less than a half wavelength, there is no grating lobe. Also, the sidelobe level is monotonously lowered as the elongation becomes larger.

Figure 2G:
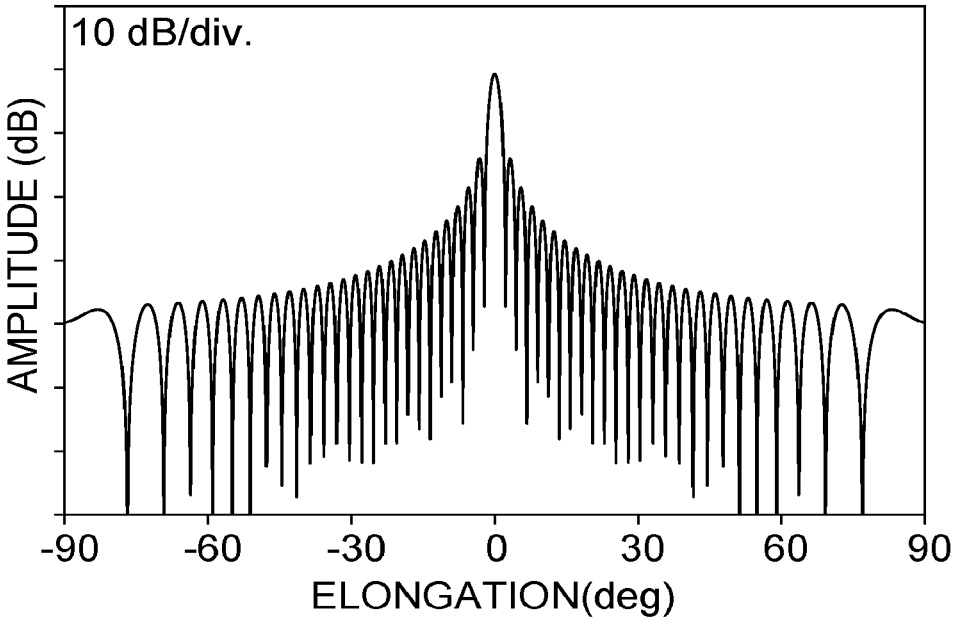
FIG. 2G is a graph indicating radiation pattern where the pitch P is equal to or less than a half wavelength.

FIG. 2G is a graph indicating radiation pattern where the pitch P is equal to or less than a half wavelength. Since no grating lobe appears, no sidelobe rise occurs even in wide-angle directions.

Therefore, in such a case as the present embodiment where a distance between centers of adjacent through-holes 108 is equal to or less than one-half of a wavelength corresponding to a predetermined frequency of radio waves, amplitude variation can be more suppressed relative to a case where the distance is greater than one-half of the wavelength. Incidentally, all of through-holes 108 not necessarily need to be provided within a distance that is equal to or less than one-half of the wavelength from respective adjacent through-holes 108 to obtain an amplitude variation suppression effect. For example, where there are thousands of through-holes 108, even if there are several sites in which the pitch P is longer than one-half of the wavelength, an amplitude variation suppression effect can be obtained. Therefore, all of the through-holes 108 not necessarily need to satisfy the condition that the through-hole 108 is provided within a distance that is equal to or less than one-half of the wavelength from a through-hole 108 adjacent thereto.

As described above, according to the present embodiment, the through-holes 108 provided in the core material 102 enhance conductivity of heat from the heat source 105 to the skin material 103 and thus enable melting of snow sticking to the surface of the skin material 103. Furthermore, as a result of a pitch between adjacent through-holes 108 being set to be equal to or less than a half wavelength, even if amplitude variation occurs in antenna aperture distribution due to the influence of the through-holes 108, a rise of sidelobes in wide-angle directions can be suppressed.

Second Embodiment

Figure 3:
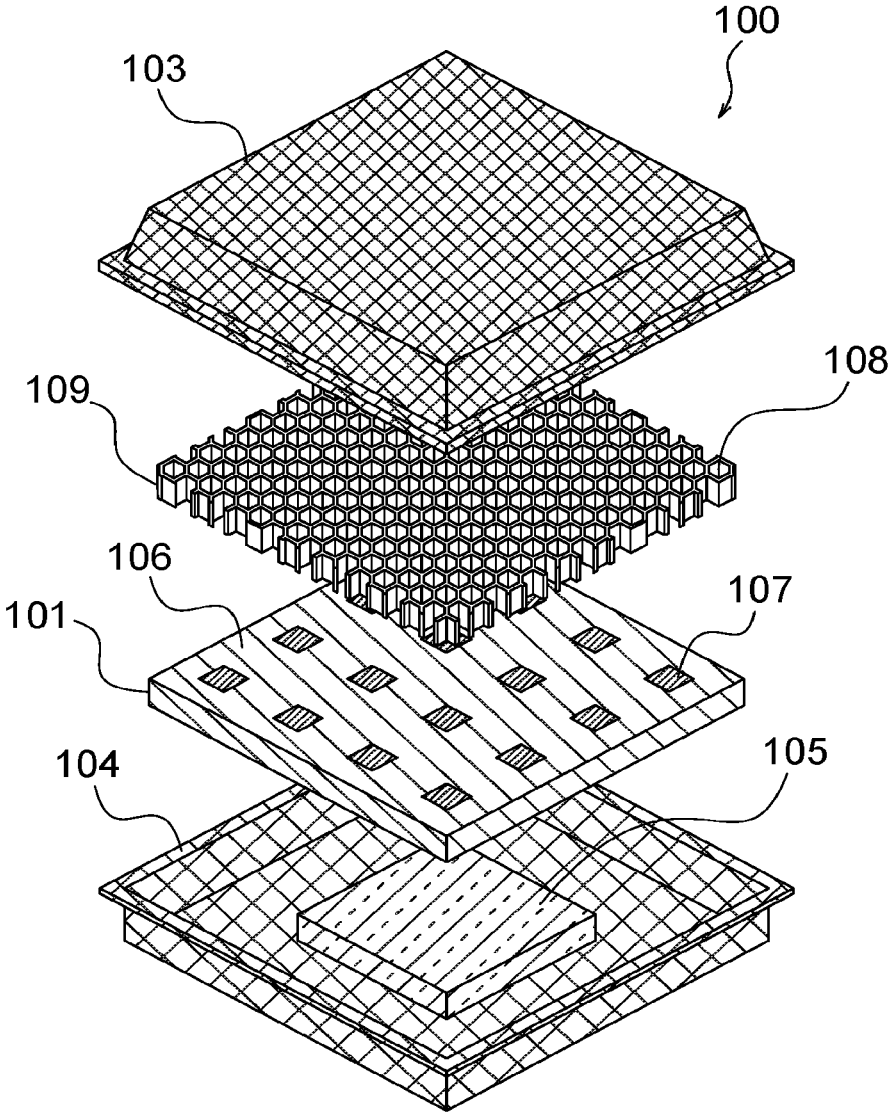
FIG. 3 is a diagram for describing an antenna device according to a second embodiment.

FIG. 3 is a diagram for describing an antenna device according to a second embodiment. The antenna device 100 according to the second embodiment is different from the first embodiment in that a core material 102 has a honeycomb structure. In the present description, the core material 102 having a honeycomb structure is referred to as "honeycomb material 109". Description of points that are similar to those of the above-described embodiment will be omitted.

Figure 4:
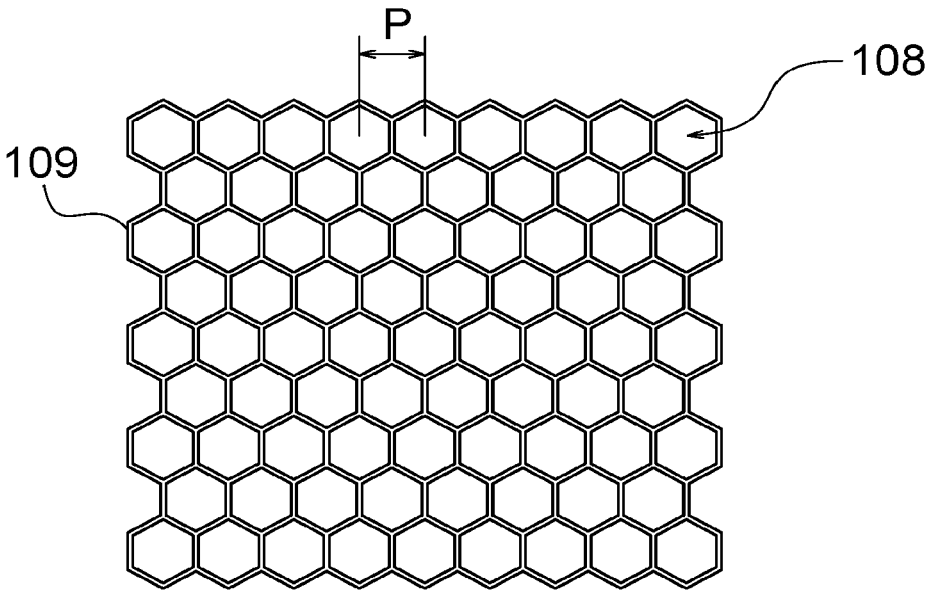
FIG. 4 is a plan view illustrating an example of a honeycomb material.

FIG. 4 is a plan view illustrating an example of a honeycomb material. A honeycomb structure is a structure in which solid figures such as regular hexagonal prisms are arranged tightly. Although a honeycomb material 109 having a structure in which hexagonal prisms are arranged tightly is illustrated in FIG. 4, the solid figures may only be regular polygonal prisms. Also, each of the regular polygonal prisms has a tubular (hollow) shape. That is, the hollow regular polygonal prisms in the honeycomb structure correspond to through-holes 108. The hollow parts of the honeycomb structure are called cells, and thus, the cells of the honeycomb structure correspond to through-holes 108.

The honeycomb material 109 is a special core material 102, and an arrangement of the honeycomb material 109 is not different from that of the core material 102. For inner wall parts (that is, ribs for partition into the cells) of the honeycomb material 109, non-conductive materials that do not block transmission of radio waves is used. For example, aramid or polypropylene may be used.

The honeycomb material 109 can be manufactured by folding and bonding the non-conductive materials. Therefore, no step of forming through-holes 108 is needed in a process of manufacturing the antenna device 100 of the second embodiment. Therefore, compared to the first embodiment, cost reduction is possible. Also, the honeycomb material 109 has a higher proportion of air compared to the core material 102 of the first embodiment and thus enables weight reduction.

A pitch P of the through-holes 108 is also set to be equal to or less than a half wavelength as in the first embodiment. In the case of a honeycomb structure, a pitch of through-holes 108 is also referred to as a cycle of cells. Therefore, a rise of sidelobes in wide-angle directions can be suppressed as in the first embodiment where a cycle of cells in a honeycomb structure is equal to or less than a half wavelength, even if amplitude variation occurs in antenna aperture distribution.

In the honeycomb material 109, air has a high occupancy and thus has a relative permittivity value close to 1. Therefore, reflection of radio waves less likely to occur in the honeycomb material 109, and reflection of radio waves occurs mainly at a skin material 103 ahead. Hence, it is preferable to suppress reflection of radio waves also in the skin material 103 by adjusting a thickness of the skin material 103. In general, reflection of radio waves is less likely to occur where a thickness of a skin material is equal to or less than one-twentieth of a wavelength. Therefore, reflection occurring at the skin material 103 may be suppressed by making the thickness of the skin material 103 to be equal to or less than around one-twentieth of the wavelength. Incidentally, the thickness of the skin material 103 in the first embodiment may be adjusted to be equal to or less than around one-twentieth of the wavelength because an effect of suppressing reflection of radio waves can be obtained.

The thickness of the skin material 103 may be uneven. Thus, it is possible that a thickness of a part of the skin material 103 is made to be equal to or less than one-twentieth of the wavelength to prevent reflection of radio waves at such part. For example, radio waves from an array antenna 101 are likely to fall on an area of orthogonal projection from the array antenna 101 to the skin material 103. Therefore, a thickness of the orthogonal projection area may also be made to be equal to or less than one-twentieth of the wavelength.

As described above, according to the present embodiment, use of a core material having a honeycomb structure in which a cycle of cells is equal to or less than a half of a wavelength enables suppressing a rise of sidelobes in wide-angle directions even if amplitude variation occurs in antenna aperture distribution. Furthermore, further cost and weight reduction can be achieved in comparison with the first embodiment.

Also, reflection by the radome can be suppressed by making a thickness of a necessary part or an entirety of the skin material 103 to be equal to or less than one-twentieth of the wavelength.

Third Embodiment

Figure 5A:
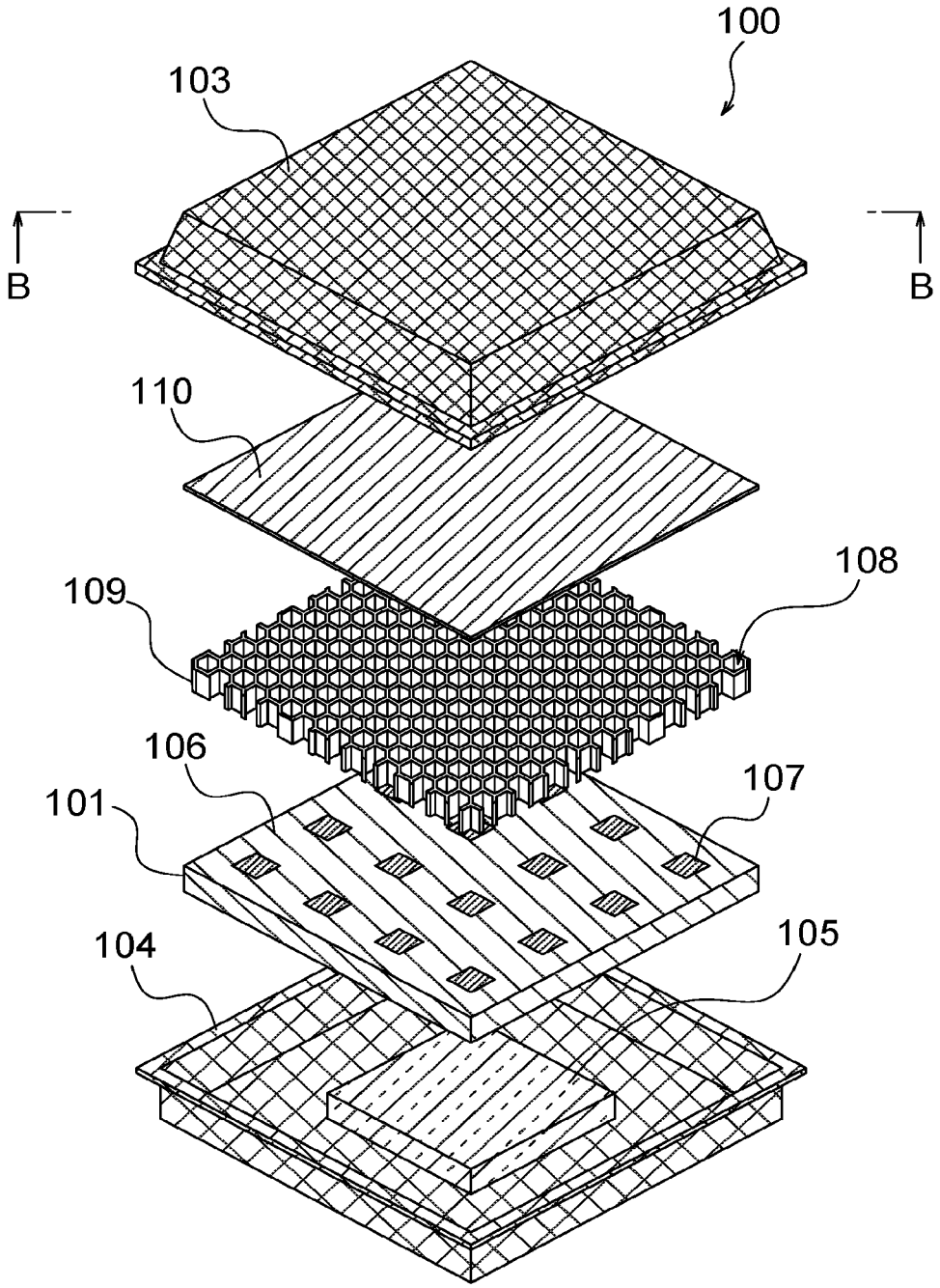
FIG. 5A is an exploded perspective view of an antenna device according to a third embodiment.
Figure 5B:
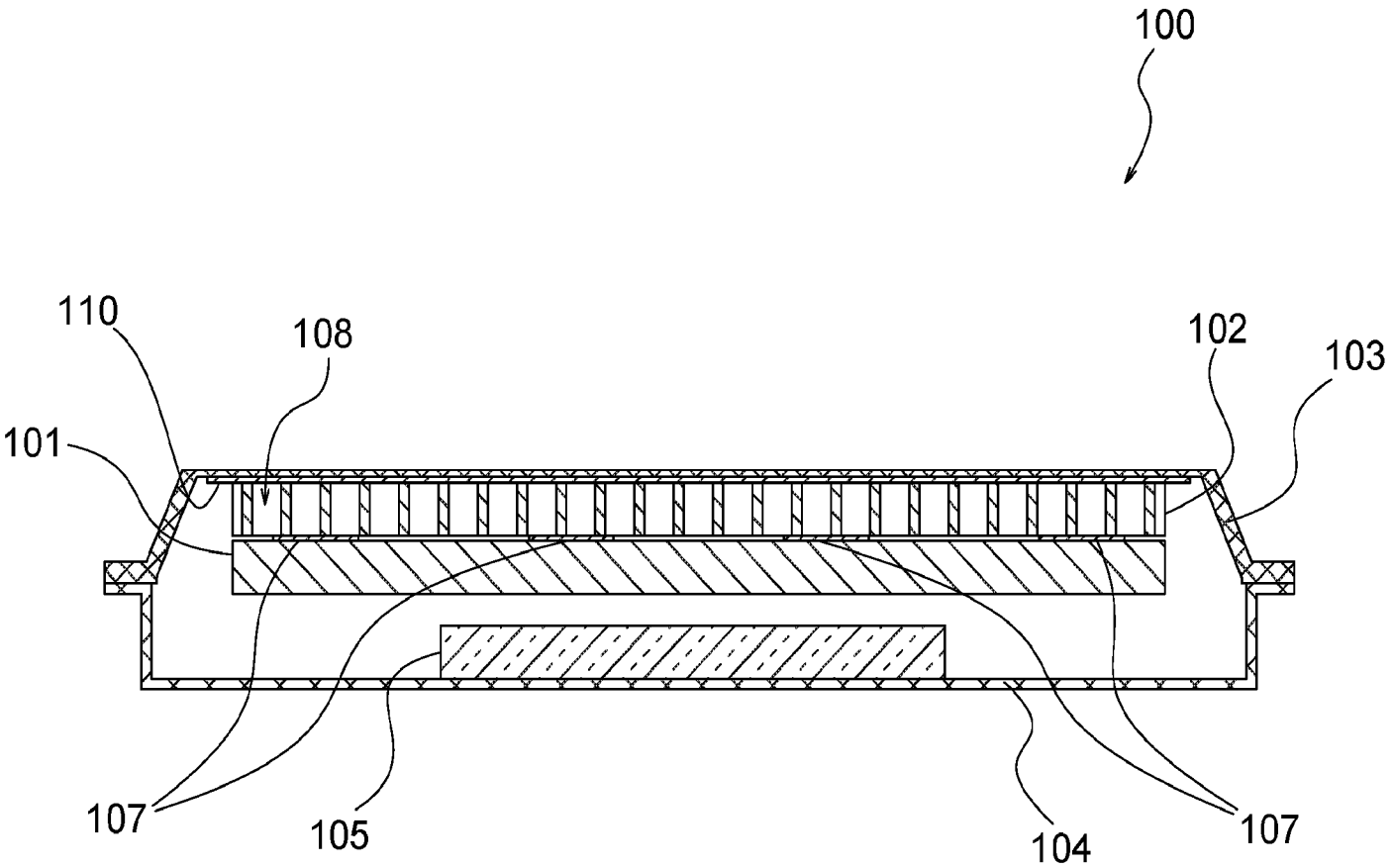
FIG. 5B is a cross-sectional view of the antenna device according to the third embodiment.

FIGS. 5A and 5B are diagrams for describing an antenna device according to a third embodiment. FIG. 5A is an exploded perspective view of the antenna device according to the third embodiment. FIG. 5B is a cross-sectional view of the antenna device according to the third embodiment. The section line for FIG. 5B is line B-B in FIG. 5A. The antenna device 100 according to the third embodiment is different from the above-described embodiments in further including a bonding layer 110. In FIGS. 5A and 5B, a bonding layer 110 is added to the second embodiment, but a bonding layer 110 may be added to the first embodiment. Description of points that are similar to those of the above-described embodiments will be omitted.

As described in the second embodiment, a thickness of a skin material 103 may be adjusted to be equal to or less than around one-twentieth of a wavelength in the perspective of return loss reduction. In such case, depending on the frequency of radio waves transmitted by the relevant antenna device 100, rigidity as a radome may be lowered. This may cause a problem when the antenna device 100 is used outdoors. Therefore, in the third embodiment, a bonding layer 110 is provided between a core material 102 or a honeycomb material 109 and a skin material 103. Consequently, the core material 102 or the honeycomb material 109 is bonded to the skin material 103, and the rigidity as a radome is enhanced.

Even if a thickness of the skin material 103 is not adjusted, the bonding layer 110 may be provided in order to enhance the rigidity as a radome. Also, a bonding layer may further be provided between the core material 102 or the honeycomb material 109 and the array antenna 101. Consequently, the rigidity can further be enhanced.

When the skin material 103, the core material 102 (or the honeycomb material 109), and the array antenna 101 are bonded to one another, the skin material 103 may be deformed because of the weight of the array antenna 101 since the array antenna 101 is located undermost as described in FIG. 5B. Therefore, e.g., a base for supporting the array antenna 101, the base being fixed to an antenna casing 104, may be provided in an internal space.

As described above, according to the present embodiment, provision of a bonding layer enables enhancement in rigidity as a radome. Therefore, even if a frequency of radio waves transmitted is high, it is possible to maintain sufficient rigidity of the radome while reducing return loss, enabling the antenna device 100 to be used outdoors.

Fourth Embodiment

Figure 6A:
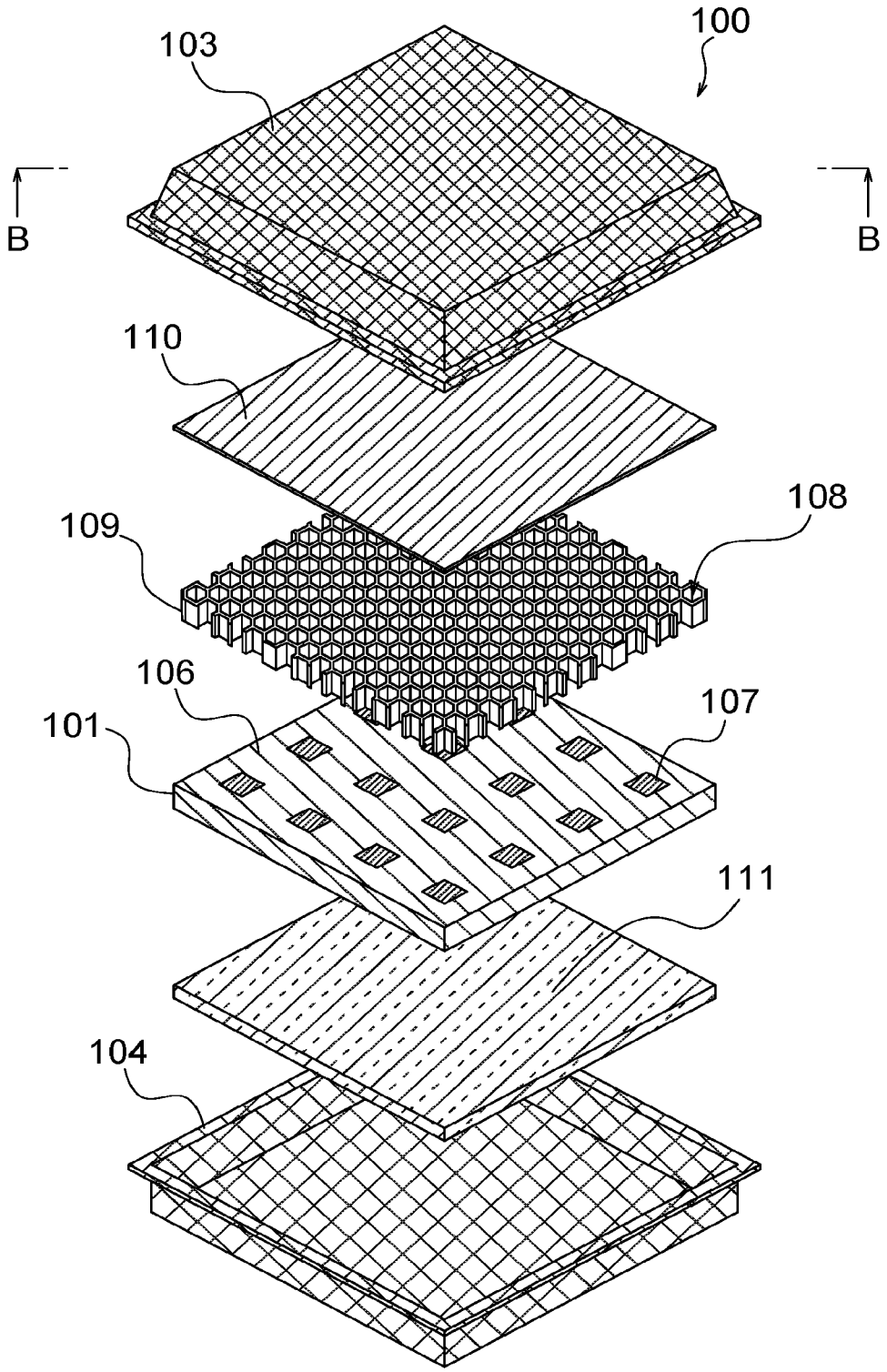
FIG. 6A is an exploded perspective view of an antenna device according to a fourth embodiment.
Figure 6B:
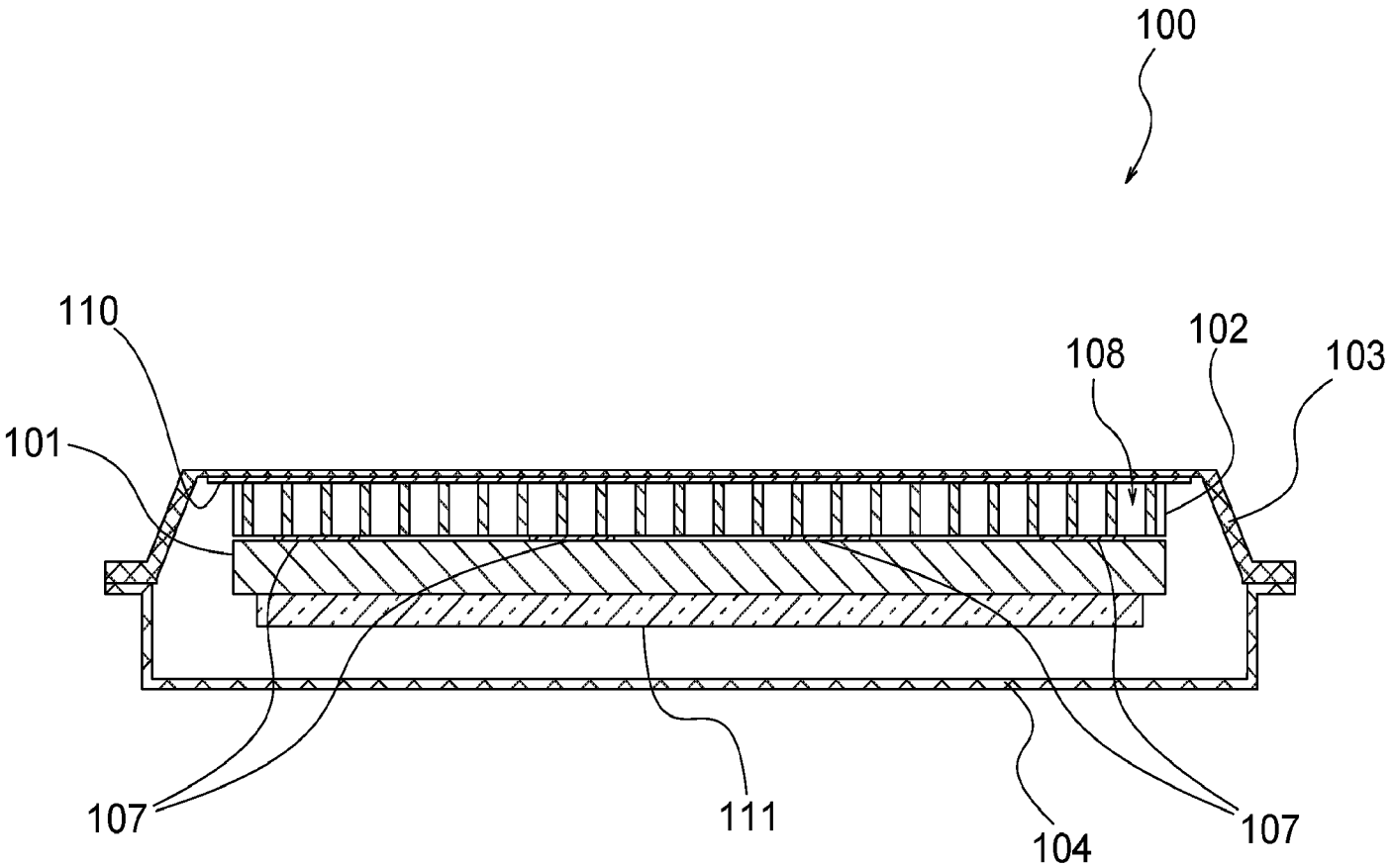
FIG. 6B is a cross-sectional view of the antenna device according to the fourth embodiment.

FIGS. 6A and 6B are diagrams for describing an antenna device according to a fourth embodiment. FIG. 6A is an exploded perspective view of the antenna device according to the fourth embodiment. FIG. 6B is a cross-sectional view of the antenna device according to the fourth embodiment. The section line for FIG. 6B is line B-B in FIG. 6A. The antenna device 100 according to the fourth embodiment is different from the above-described embodiments in that a film heater 111 is used as a heat source 105. In FIGS. 6A and 6B, a heat source 105 in the third embodiment is changed to a film heater 111, but a film heater 111 may be used in the first and second embodiments. Description of points that are similar to those of the above-described embodiments will be omitted.

As with the heat source 105 according to each of the above-described embodiments, the film heater 111 have only to be present in an internal space and to be disposed at a position at which the film heater 111 does not block radio waves. From the perspective of its shape and heat conductivity, it is assumed that the film heater 111 is bonded to a back surface opposite to a radiation surface 106 of an array antenna 101 as illustrated in FIG. 5B.

When the film heater 111 and the array antenna 101 are in contact with each other, the array antenna 101 is warmed directly by heat emitted by the film heater 111. The warmed array antenna 101 warms air charged in through-holes 108, and consequently, the skin material 103 is warmed. On the other hand, when the film heater 111 and the array antenna 101 are not in contact with each other, the entire air in the internal space is warmed, and the skin material 103 is then warmed. Therefore, warming efficiency is low. Accordingly, use of the film heater 111 that is in contact with the back surface opposite to the radiation surface 106 of the array antenna 101 enables heat conductivity enhancement relative to the above-described embodiments.

As described in the third embodiment, if, e.g., a base that supports the array antenna 101 is provided in the internal space, the film heater 111 may be fixed not by bonding but by providing the film heater 111 between the base and the array antenna 101.

As described above, according to the present embodiment, use of the film heater 111 as a heat source 105 enables enhancement in capability of warming the array antenna 101. Consequently, a capability of warming the skin material 103 is enhanced relative to the above-described embodiments. Therefore, an antenna device delivering higher performance of melting snow on a surface of the skin material 103 relative to the above-described embodiments can be provided.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

The invention claimed is:

1. An antenna device, comprising:

a plurality of radiation elements configured to transmit radio waves of a predetermined frequency;

an array antenna having a radiation surface on which the plurality of radiation elements are disposed and a back surface opposite to the radiation surface;

a skin material disposed in a direction in which the skin material faces the radiation surface;

a core material disposed between the array antenna and the skin material, the core material having a plurality of through-holes; and an antenna casing disposed in a direction in which the antenna casing faces the back surface, wherein a distance between centers of adjacent through-holes of the plurality of through-holes is equal to or less than one-half of a wavelength corresponding to the predetermined frequency; and a distance between adjacent radiation elements of the plurality of radiation elements is longer than the distance between the centers of the adjacent through-holes of the plurality of through-holes.

2. The antenna device according to claim 1, wherein the distance between the centers of the adjacent through-holes is equal to or less than one-half of the wavelength to suppress amplitude variation occurring in antenna aperture distribution in a surface of the skin material.

3. The antenna device according to claim 1, wherein:

the core material has a honeycomb structure; and cells of the honeycomb structure correspond to the through-holes.

4. The antenna device according to claim 1, wherein a thickness of a part or an entirety of the skin material is equal to or less than one-twentieth of the wavelength.

5. The antenna device according to claim 1, further comprising a bonding layer configured to bond the skin material and the core material to each other.

6. The antenna device according to claim 1, further comprising a heat source disposed in a space surrounded by the antenna casing and the skin material.

7. The antenna device according to claim 6, wherein:

the heat source is a film heater; and the heat source is in contact with the back surface.

8. The antenna device according to claim 1, wherein the distance between the adjacent radiation elements is longer than one-half of the wavelength corresponding to the predetermined frequency.

9. The antenna device according to claim 1, wherein the core material has an insulating property.

* * * * *